US010372084B2

(12) United States Patent
Morohoshi

(10) Patent No.: US 10,372,084 B2
(45) Date of Patent: Aug. 6, 2019

(54) ANALOG ELECTRONIC WATCH

(71) Applicant: CASIO COMPUTER CO., LTD., Shibuya-ku, Tokyo (JP)

(72) Inventor: Hiroshi Morohoshi, Tokorozawa (JP)

(73) Assignee: CASIO COMPUTER CO., LTD, Tokyo (JP)

( * ) Notice: Subject to any disclaimer, the term of this patent is extended or adjusted under 35 U.S.C. 154(b) by 169 days.

(21) Appl. No.: 15/207,947

(22) Filed: Jul. 12, 2016

(65) Prior Publication Data

US 2017/0075306 A1 Mar. 16, 2017

(30) Foreign Application Priority Data

Sep. 10, 2015 (JP) ..... 2015-178344

(51) Int. Cl.
*G04B 19/04* (2006.01)
*G04C 3/14* (2006.01)

(52) U.S. Cl.
CPC ..... *G04B 19/04* (2013.01); *G04C 3/14* (2013.01)

(58) Field of Classification Search
CPC ..... G04C 3/14; G04B 19/04; G04B 19/048
See application file for complete search history.

(56) References Cited

U.S. PATENT DOCUMENTS

| | | | | |
|---|---|---|---|---|
| 5,497,358 | A | 3/1996 | Koch | |
| 5,959,941 | A * | 9/1999 | Murakami | G04F 8/00 368/110 |
| 8,259,536 | B2 * | 9/2012 | Hasegawa | G04C 3/146 368/80 |
| 9,022,643 | B2 * | 5/2015 | Nagareda | G04C 3/14 368/187 |

FOREIGN PATENT DOCUMENTS

| | | | |
|---|---|---|---|
| JP | 2001249190 | A | 9/2001 |
| JP | 2004061423 | A | 2/2004 |
| JP | 2004226350 | A | 8/2004 |
| JP | 2011128026 | A | 6/2011 |
| JP | 2011220725 | A | 11/2011 |
| JP | 2013104866 | A | 5/2013 |
| JP | 2014048148 | A | 3/2014 |
| JP | 2015036627 | A | 2/2015 |

OTHER PUBLICATIONS

Japanese Office Action (and English language translation thereof) dated Jun. 11, 2019 issued in counterpart Japanese Application No. 2015-178344.

* cited by examiner

*Primary Examiner* — Edwin A. Leon
*Assistant Examiner* — Jason M Collins
(74) *Attorney, Agent, or Firm* — Holtz, Holtz & Volek PC

(57) ABSTRACT

An analog electronic watch includes a hand and a control unit. The hand is configured to be rotatable. The control unit fast-forwards the hand to perform a fast-forward operation in different ways according to whether a type of a display object after switching is a time type or a period type, in a case where display contents are switched by using the hand.

13 Claims, 15 Drawing Sheets

(FIG. 3 CONTINUED)
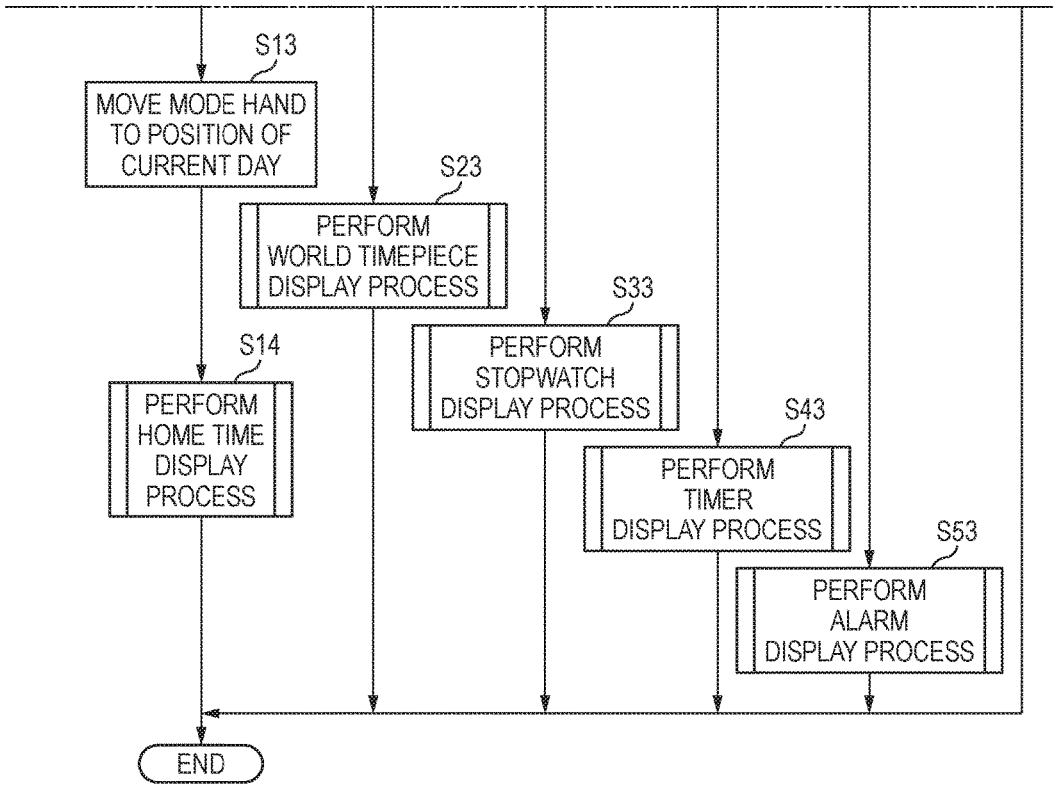

(CONT.)

(FIG. 13 CONTINUED)
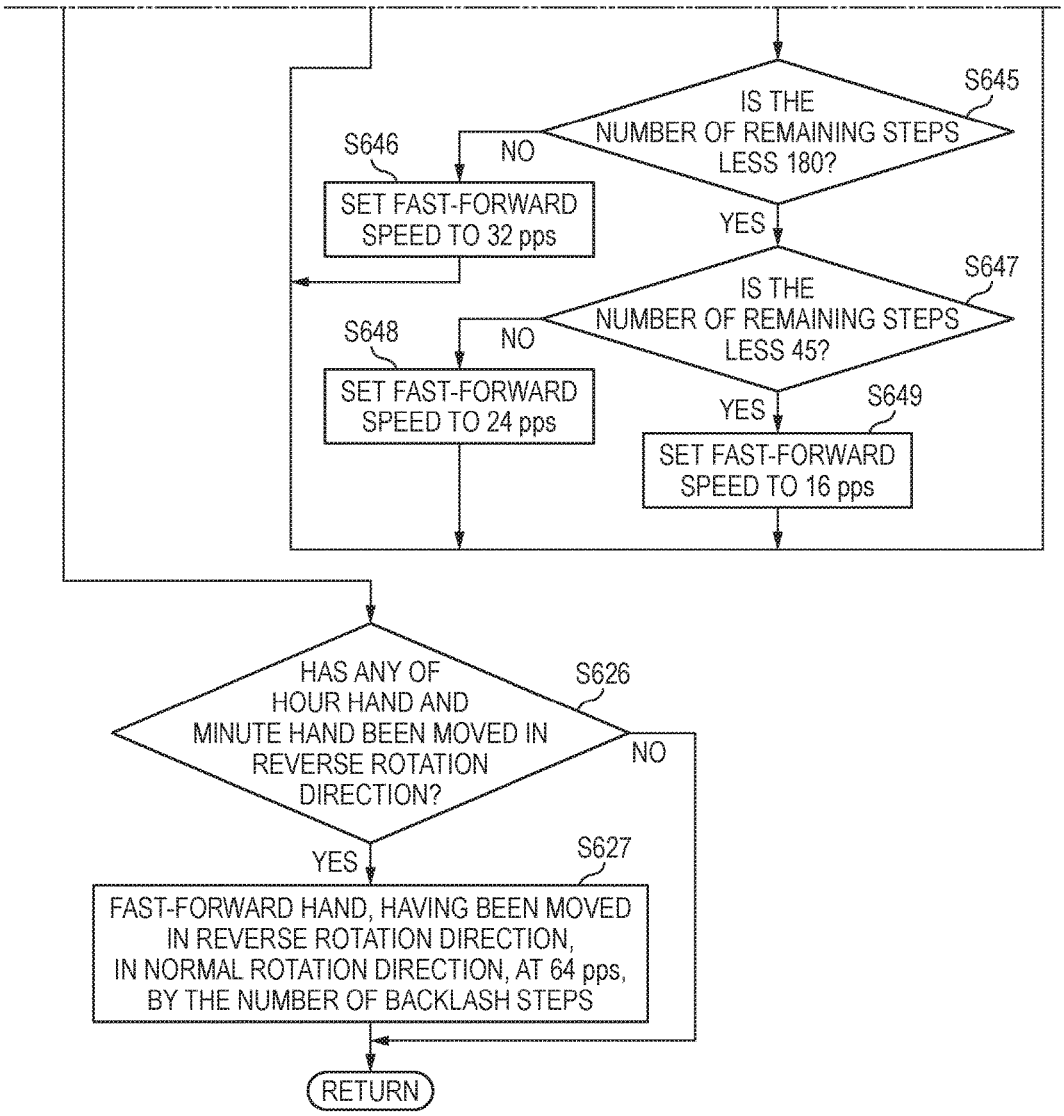

(CONT.)

(FIG. 15 CONTINUED)
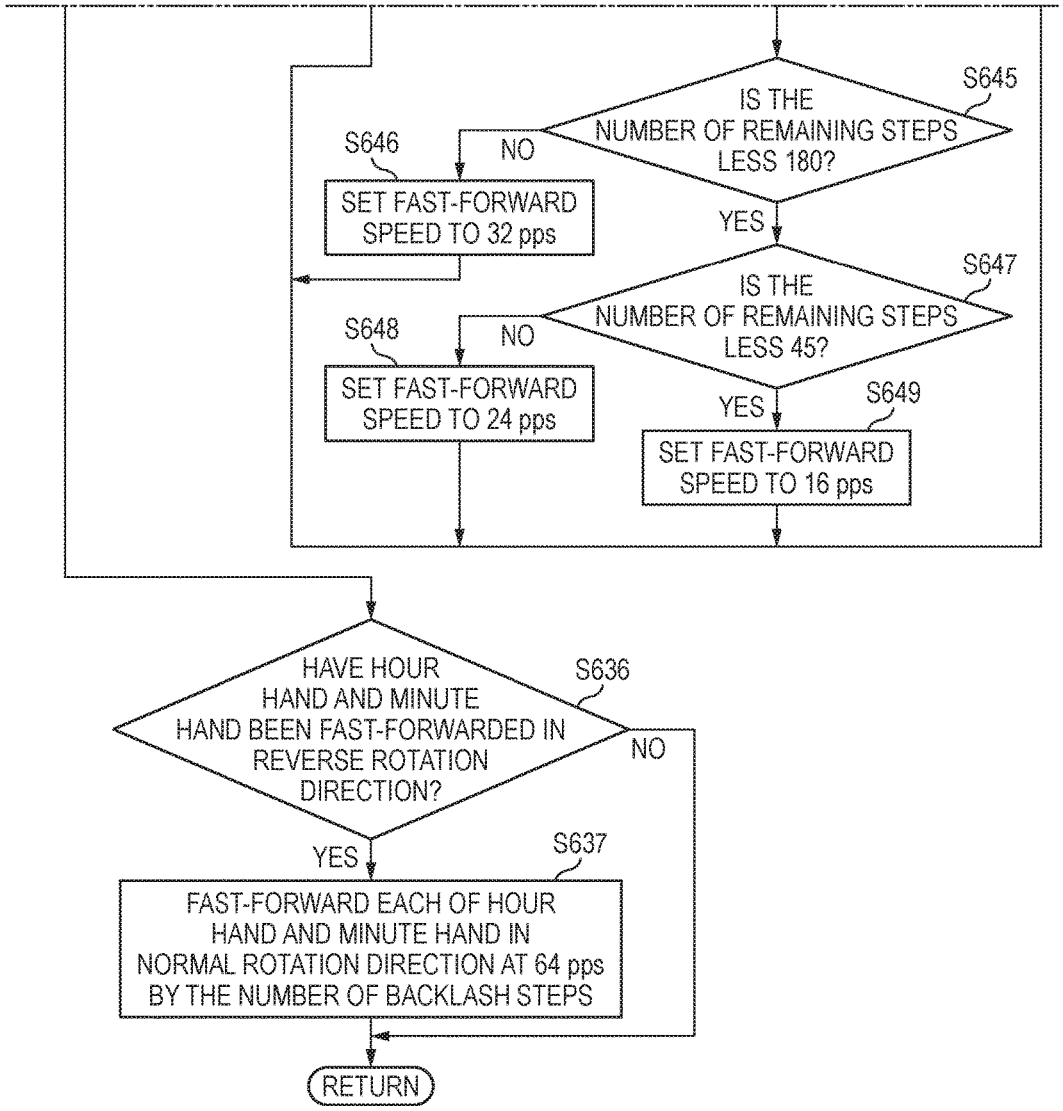

ANALOG ELECTRONIC WATCH

CROSS-REFERENCE TO RELATED APPLICATION

This application is based upon and claims the benefit of priority from the prior Japanese Patent Application No. 2015-178344, filed on Sep. 10, 2015, and the entire contents of which are incorporated herein by reference.

BACKGROUND OF THE INVENTION

1. Field of the Invention

The present invention relates to an analog electronic watch which performs time display using hands.

2. Description of the Related Art

In the related art, there are analog electronic watches which perform time display by rotating a plurality of hands using stepping motors configured to electrically operate. In these analog electronic watches, since contents which can be indicated by hands are limited, there are multi-function watches capable of performing display of a plurality of display objects, such as display of not only the time at the current location but also the time in various places around the world, display of periods related to other functions such as a stopwatch function and a timer function, and display based on a value measured by a sensor or the like, by switching.

Multi-function watches have a problem that it is difficult to realize which function is related to display that is being performed by hands. For this reason, in the related art, there are technologies for notifying a specific situation by making hands perform specific operations or disposing a plurality of hands in a specific positional relation (for example, JP-A-2004-61423 and JP-A-2011-220725). Also, there is a technology for providing a mode hand, in addition to time hands for displaying time, such that the mode hand indicates a function related to display which is being performed. Further, there is a technology for using one of time hands as a mode hand to temporarily display a function related to display to be performed, without increasing the number of hands and stepping motors (for example, JP-A-2004-226350).

However, separately provided mode hands are smaller than time hands or get covered up by time hands, and therefore, it is difficult to see the mode hands. Meanwhile, if display related to selection of a function is temporarily performed by a time hand, meanwhile, switching to display related to the selected function is impossible.

SUMMARY OF THE INVENTION

An object of the present invention is to provide an analog electronic watch capable of making it easier to realize switch display objects during switching of display contents.

An analog electronic watch includes a hand and a control unit. The hand is configured to be rotatable. The control unit fast-forwards the hand to perform a fast-forward operation in different ways according to whether a type of a display object after switching is a time type or a period type, in a case where display contents are switched by using the hand.

According to the present invention, there is an effect that it is possible to make it easier to realize switch display objects during switching of display contents in an analog electronic watch.

DETAILED DESCRIPTION OF THE PREFERRED EMBODIMENTS

Hereinafter, embodiments of the present invention will be described with reference to the accompanying drawings.

First Embodiment

Figure 1:
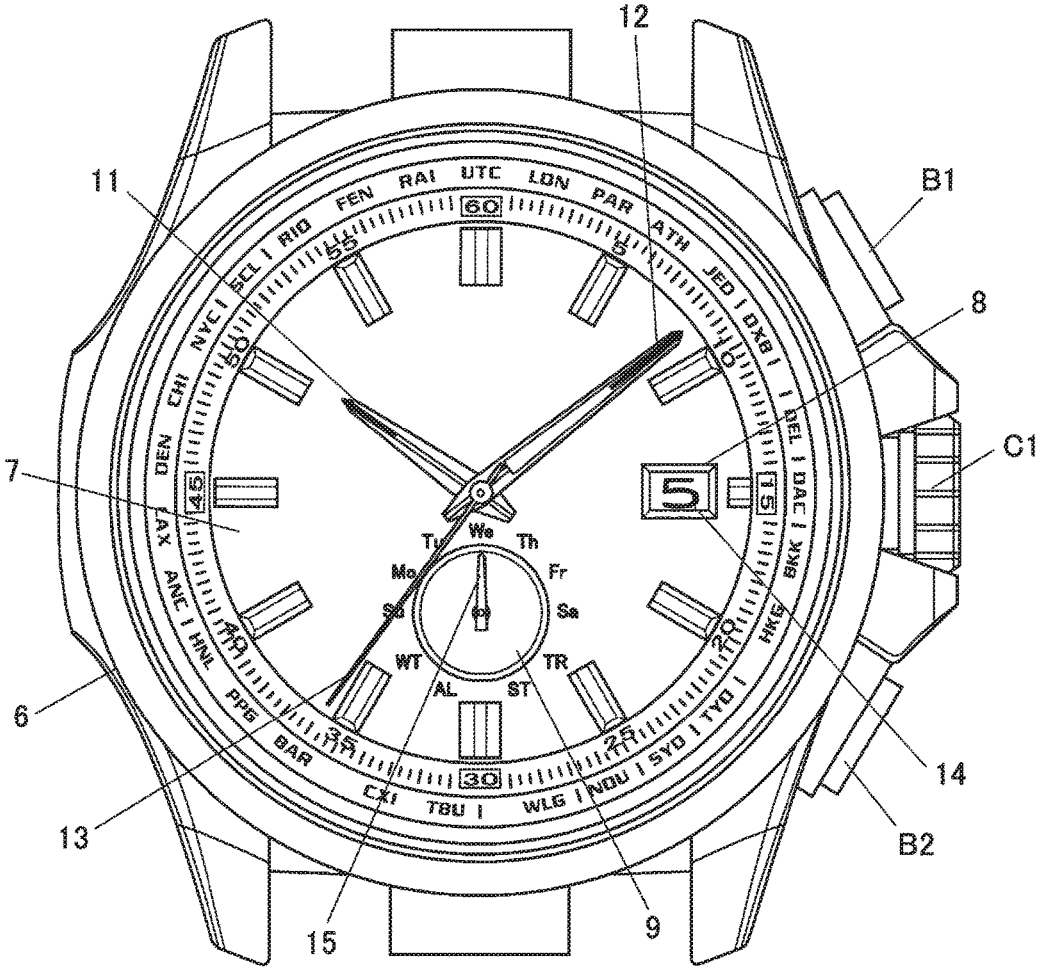
FIG. 1 is a front view illustrating an analog electronic watch of a first embodiment of the present invention.

FIG. 1 is a front view illustrating an analog electronic watch of a first embodiment of an electronic watch of the present invention.

An analog electronic watch 1 of the present embodiment is an electronic wristwatch which includes a date wheel 14 which is a rotary disc and can display date and time by five hands. In the analog electronic watch 1, in a space surrounded by a casing 6, a dial 7, and windshield glass (not shown) for covering the front face, an hour hand 11, a minute hand 12, a second hand 13, and a mode hand 15 are provided. Also, the date wheel 14 is provided on the back side of the dial 7 (the opposite side of the dial to the windshield glass (the exposed face)), almost in parallel with the dial 7. Among these components, the hour hand 11, the minute hand 12, the second hand 13, and the date wheel 14 are disposed so as to be rotatable on the same shaft, and the mode hand 15 is disposed inside a small window 9 formed in the dial 7 in the direction of 6 o'clock so as to be rotatable. On the side of the casing 6, push button switches B1 and B2 and a stem C1 are provided.

On the circumference of the small window 9, marks for representing a functional mode which is being performed or the day of the week in the current home location are provided at regular intervals. In other words, marks representing Sunday to Saturday, a mark "WT" related to a world timepiece function, a mark "AL" related to an alarm function, a mark "ST" related to a stopwatch function, and a mark "TR" related to a timer function are provided.

The date wheel 14 is an annular rotary disc. On the circumference of the disc, marks (date marks) "1" to "31" representing dates are sequentially arranged at regular intervals. If the date wheel 14 is rotated, one date mark is exposed from an opening 8 formed in the dial 7 in the direction of 3 o'clock, whereby the date is shown.

The push button switches B1 and B2 receive user's operations of pushing them. The stem C1 can be pulled out in two stages, and thus can receive an operation of pulling the crown out, an operation of rotating the pulled crown, and an operation of pushing the crown back.

Figure 2:
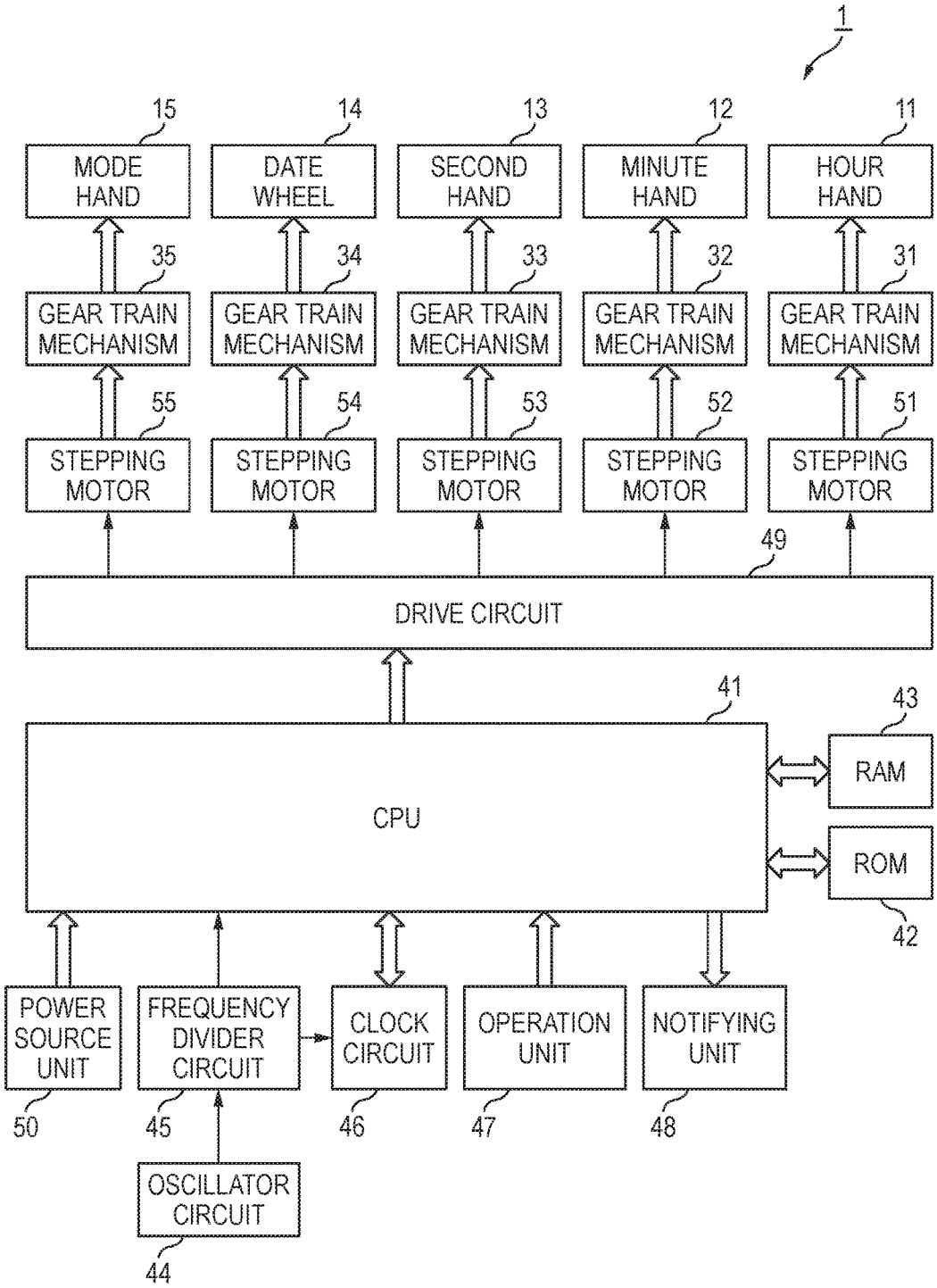
FIG. 2 is a block diagram illustrating the functional configuration of the analog electronic watch.

FIG. 2 is a block diagram illustrating the functional configuration of the analog electronic watch 1 of the present embodiment.

The analog electronic watch 1 includes the hour hand 11, a stepping motor 51 configured to rotate the hour hand 11 through a gear train mechanism 31, the minute hand 12, a stepping motor 52 configured to rotate the minute hand 12 through a gear train mechanism 32, the second hand 13, a stepping motor 53 configured to rotate the second hand 13 through a gear train mechanism 33, the date wheel 14, a stepping motor 54 configured to the date wheel 14 through a gear train mechanism 34, the mode hand 15, a stepping motor 55 configured to rotate the mode hand 15 through a gear train mechanism 35, a central processing unit (CPU) 41 configured as a control unit, a read only memory (ROM) 42, a random access memory (RAM) 43, an oscillation circuit 44, a frequency divider circuit 45, a clocking circuit 46, an operation unit 47 configured as an operation receiving unit, a notifying unit 48, a drive circuit 49, a power source unit 50, and so on.

The CPU 41 is a processor configured to perform a variety of arithmetic processing and generally control operations of the whole of the analog electronic watch 1. Also, the CPU 41 outputs control signals to the drive circuit 49 at appropriate timings, thereby rotating the hour hand 11, the minute hand 12, the second hand 13, the date wheel 14, and the mode hand 15 (all or some of which will hereinafter be referred to collectively as the hands 11 to 15 and the like).

The ROM 42 stores various programs to be executed by the CPU 41, and initial setting data to be used by the various programs. These programs and the initial setting data are read out, and executed or used by the CPU 41, during activating of the analog electronic watch 1 and whenever necessary.

Also, as the ROM 42, various types of non-volatile memory called rewritable flash memory and electrically erasable programmable read only memory (EEPROM) can be used.

The RAM 43 provides a memory space for work to the CPU 41, and temporarily stores data. In temporary data which is stored in the RAM 43, data related to individual functions, such as setting data and history data, is included. For example, as temporary data related to a home time display function (a basic function) and a world timepiece function, local time setting information required in each timepiece function is included. For example, information on time zones and practice of daylight saving time, and the time (local time) of each place calculated from date and time clocked based on the setting information by the clocking circuit 46 are included. As temporary data related to a stopwatch function, lap times and split times measured during execution of the stopwatch function, the history of times measured in the past, and the like are included. Also, as temporary data related to a timer function, information on a set time period to be measured during execution of timer measurement, and information on the remaining time period at the timing of interruption in a case of interrupting counting are included. Also, as temporary data related to an alarm function, alarm setting times, and settings on whether the alarm operation is active or inactive are included.

The oscillation circuit 44 generates a predetermined frequency signal, and outputs the generated frequency signal to the frequency divider circuit 45. The frequency divider circuit 45 divides the frequency of the frequency signal input from the oscillation circuit 44, thereby generating a signal having a frequency set by a control signal from the CPU 41, and outputs the generated signal to the CPU 41. Also, the frequency divider circuit 45 generates a predetermined frequency signal (for example, a one-second signal), and outputs the generated signal to the clocking circuit 46. The clocking circuit 46 is a counter configured to count input frequency signals, thereby counting date and time. Alternatively, the clocking circuit 46 may be a memory such as a DRAM configured to store date and time counted in a software wise by the CPU 41.

The operation unit 47 receives an operation of a user (a user's operation) from the outside, and converts the user's operation into an electric signal, and outputs the electric signal as an input signal to the CPU 41. In the operation unit 47, the push button switches B1 and B2 and the stem C1 are included. The user can correct the current time, or make the watch display the times (local times) of various places around the world, or make the watch perform an operation related to each function of the alarm function, the stopwatch function, and the timer function, by performing input operations on the push button switches B1 and B2 and the stem C1.

The notifying unit 48 performs a predetermined notifying operation for the user. As examples of the predetermined notifying operation, generation of buzzer sound, generation of vibration, turning on (turning on and off) of a lamp, and the like can be taken. The notifying unit 48 includes one or more of components corresponding to the above described operations. For example, in order to generate buzzer sound, a piezoelectric element having electrodes attached to both ends, and a diaphragm can be used. In order to generate vibration, for example, a rotary motor having a spindle can be used. Also, as a lamp, for example, an LED can be used.

The power source unit 50 supplies electric power required for operations, to the CPU 41. The power source unit 50 is not particularly limited, and may be a unit configured by combining a solar panel and a secondary battery and capable of stably supplying electric power for a long time. Also, the CPU 41 supplies electric power supplied from the power source unit 50, to the other units.

The stepping motors 51 to 55 can be driven in steps based on the voltage waveforms of drive pulses input from the drive circuit 49, respectively, thereby independently rotating the plurality of hands 11 to 15 in units of predetermined angles in a normal rotation direction (a direction in which a time period or time proceeds) or a reverse rotation direction (a direction in which a time period or time returns back). The stepping motors 51 to 55 can be driven in the normal rotation direction by drive pulses having a maximum rate of 64 pps (pulse per second), and can be driven in the reverse rotation direction by drive pulses having a maximum rate of 32 pps.

The drive circuit 49 outputs drive pulses having predetermined pulse widths to the stepping motors 51 to 55, respectively, based on control signals output from the CPU 41 and related to operations of the hands 11 to 15. The drive circuit 49 is configured not to output drive pulses to a plurality of stepping motors at the same time. In other words, in a case where hand movement commands related to a plurality of hands are input at the same time, the drive circuit 49 sequentially outputs drive pulses to the individual stepping motors, according to priorities predetermined for the hands to be moved.

In the analog electronic watch 1 of the present embodiment, the gear train mechanisms 31 to 35 are configured such that, whenever the stepping motors 51 to 55 are driven by one step, the hour hand 11 and the minute hand 12 rotate by 1 degree, and the second hand 13 and the mode hand 15 rotate by 6 degrees, and the date wheel 14 rotates by 1/124 degrees (360/(31×1440) degrees). Therefore, in a normal time display mode, the second hand 13 rotates by one step every one second (a unit of time of the second hand 13) based on the intervals (time units) at which drive pulses are input to the stepping motor 53. Also, while being interlocked with movement of the second hand 13 (at the time ratio of 1:10), the minute hand 12 rotates by one step every ten seconds (a unit of time of the second hand 13) (whenever the second hand 13 moves by 10 steps) at the timings when a digit in ones place in seconds becomes 0. Also, while being interlocked with movement of the minute hand 12 (at the time ratio of 1:12), the hour hand 11 rotates by one step every two minutes (a unit of time of the hour hand 11) (whenever the minute hand 12 moves by 12 steps) at the timings when a digit in ones place in minutes becomes an even number). In the above described way, operation control (an interlocking operation) is performed. As the date is changed, that is, at every other timing when the hour hand 11 indicates the direction of 12 o'clock, the date wheel 14 is fast-forwarded so as to rotate by 1440 steps once such that display changes by a day.

Here, as for positions of the hands, as the positions of the second hand 13, a position "0" is set to a position where it indicates 0 seconds, and positions "1" to "59" are set sequentially in the normal rotation direction. Also, as positions of each of the minute hand 12 and the hour hand 11, a position "0" is set to a position at which it indicates 0 minutes (0 o'clock), and positions "1" to "359" are set sequentially in the normal rotation direction. Also, in a case where the minute hand 12 and the hour hand 11 display time, as positions (interlocking positions) representing combinations of positions of the minute hand 12 and the hour hand 11, a position "0" is set to a position where they exactly indicate 0 o'clock, and positions "1" to "4319" are set sequentially at intervals of 10 seconds until they indicate 59 minutes and 50 seconds past 11 o'clock, and these values are used to manage the current positions of the hands and the positions of fast-forward destinations of the hands (hand movement destination positions).

In the gear train mechanisms 31 to 35, since there is play (backlash) between gears, in a case of reversing the rotation direction, idle rotation by steps attributable to the backlash occurs. The number of idle rotation steps (the number of backlash steps) is tested with respect to each of the hands 11 to 15, in advance, and is stored and held in the ROM 42 or the like. Also, in view of a change in the amount of play depending on a temperature condition and the like, the number of backlash steps may be set to be slightly large.

Now, a display operation using the hands 11 to 15 in the analog electronic watch 1 of the present embodiment will be described.

In the analog electronic watch 1 of the present embodiment, display contents are switched by user's input operations on the operation unit 47. For example, if the push button switch B2 is pushed, functions (display objects) are changed, and the hands 11 to 15 are fast-forwarded to positions (display states) according to the display content related to the switched function. As a result, the display contents based on the hands 11 to 15 are switched. As described above, in the analog electronic watch 1, in addition to the function of displaying the current time (home time) of the current location (home location) which is a basic operation, the world timepiece function, the stopwatch function, the timer function, and the alarm function can be executed, and in parallel with switching between functions, or after changing of display contents, an operation control program related to each function is activated, whereby a transition to each function is performed.

For example, in the home time display function or the world timepiece function, if the stem C1 is pulled out in two stages, and is rotated, an operation of changing the current position or the world timepiece position is performed.

Also, in the stopwatch function, if the push button switch B1 is pushed, time measurement is started or stopped, the elapsed time between the start timing and the stop timing (between timings determined in response to operations) is counted.

Information such as the histories of the changed settings and the counted elapsed times can be appropriately stored in the RAM 43, and be read out of the RAM 43 and be displayed in a case of performing change from the corresponding function to another function and then performing switching to the corresponding function again, or in a case where the corresponding information is called in the corresponding function.

Figure 3:
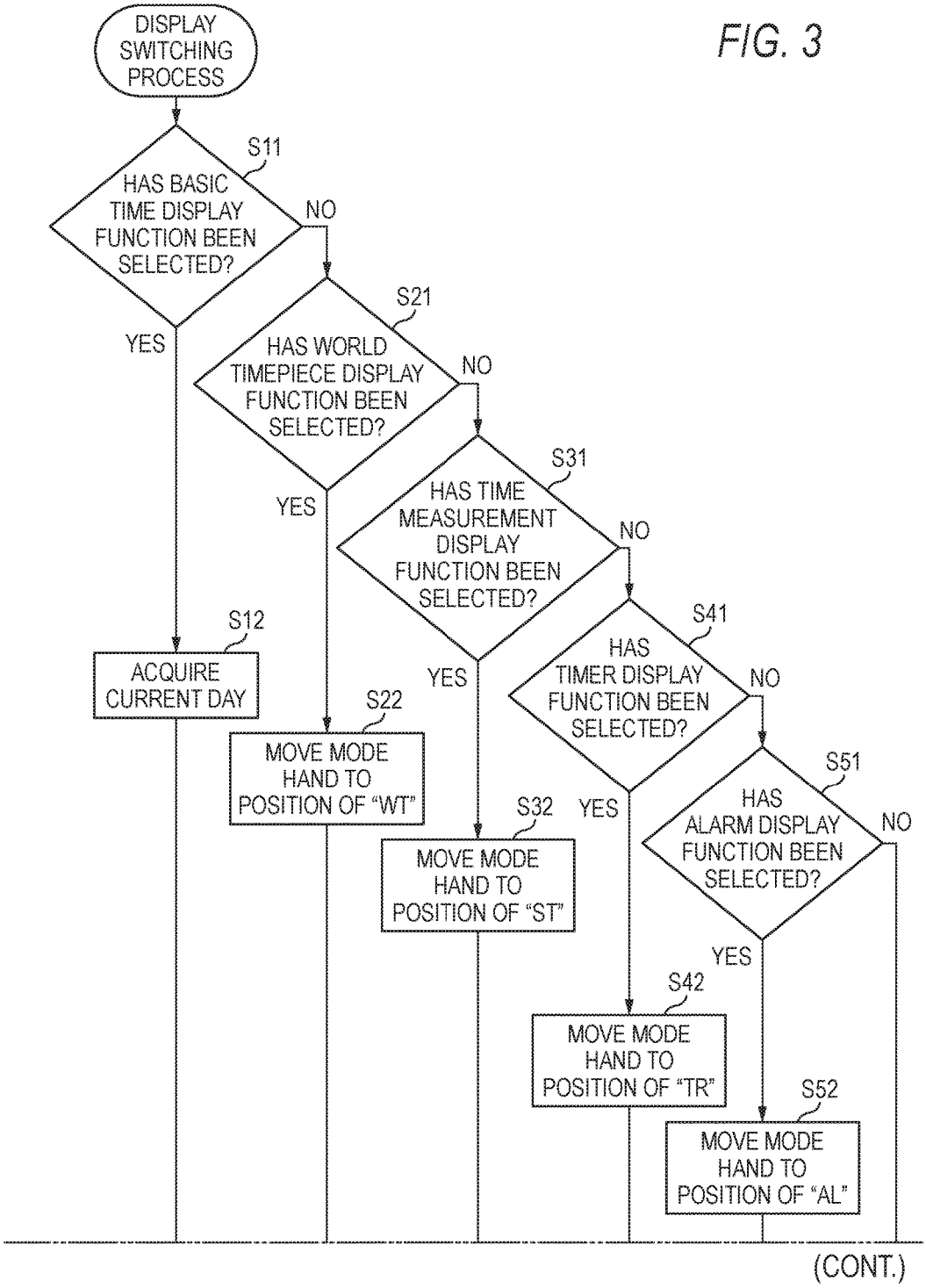
FIG. 3 is a flow chart illustrating the control procedure of a display switching process of the analog electronic watch of the first embodiment.

FIG. 3 is a flow chart illustrating the control procedure of a display switching process which the CPU 41 performs in the analog electronic watch 1 of the present embodiment.

This display switching process is activated if an operation of pushing the push button switch B2 is detected.

If the display switching process is started, in STEP S11, the CPU 41 determines whether a selected display function is home time display. In a case where it is determined that the selected display function is home time display ("YES" in STEP S11), in STEP S12, the CPU 41 acquires the current day at the current location based on date/time information which is counted by the clocking circuit 46. Subsequently, in STEP S13, the CPU 41 outputs a control signal to the drive circuit 49, thereby making the mode hand 15 indicate a mark corresponding to the corresponding day. Thereafter, the CPU 41 calls and performs a home time display process in STEP S14. After the home time display process finishes, the CPU finishes the display switching process.

In a case where it is determined that the selected display function is not home time display ("NO" in STEP S11), in STEP S21, the CPU 41 determines whether the selected display function is world timepiece display. In a case where it is determined that the selected display function is world timepiece display ("YES" in STEP S21), in STEP S22, the CPU 41 outputs a control signal to the drive circuit 49, thereby making the mode hand 15 indicate the mark "WT". Subsequently, in STEP S23, the CPU 41 calls and performs a world timepiece display process. After the world timepiece display process finishes, the CPU finishes the display switching process.

In a case where it is determined that the selected display function is not world timepiece display ("NO" in STEP S21), in STEP S31, the CPU 41 determines whether the selected display function is time measurement display (stopwatch). In a case where it is determined that the selected display function is time measurement display ("YES" in STEP S31), in STEP S32, the CPU 41 outputs a control signal to the drive circuit 49, thereby making the mode hand 15 indicate the mark "ST". Subsequently, in STEP S33, the CPU 41 calls and performs a stopwatch display process. After the stopwatch display process finishes, the CPU finishes the display switching process.

In a case where the selected display function is not time measurement display ("NO" in STEP S31), in STEP S41, the CPU 41 determines whether the selected display function is timer display. In a case where it is determined that the selected display function is timer display ("YES" in STEP S41), in STEP S42, the CPU 41 outputs a control signal to the drive circuit 49, thereby making the mode hand 15 indicate the mark "TR". Subsequently, in STEP S43, the CPU 41 calls and performs a timer display process. After the timer display process finishes, the CPU finishes the display switching process.

In a case where it is determined that the selected display function is not timer display ("NO" in STEP S41), in STEP S51, the CPU 41 determines whether the selected display function is alarm display. In a case where it is determined that the selected display function is alarm display ("YES" in STEP S51), in STEP S52, the CPU 41 outputs a control signal to the drive circuit 49, thereby making the mode hand 15 indicate the mark "AL". Subsequently, in STEP S53, the CPU 41 calls and performs an alarm display process. After the alarm display process finishes, the CPU finishes the display switching process.

Figure 4:
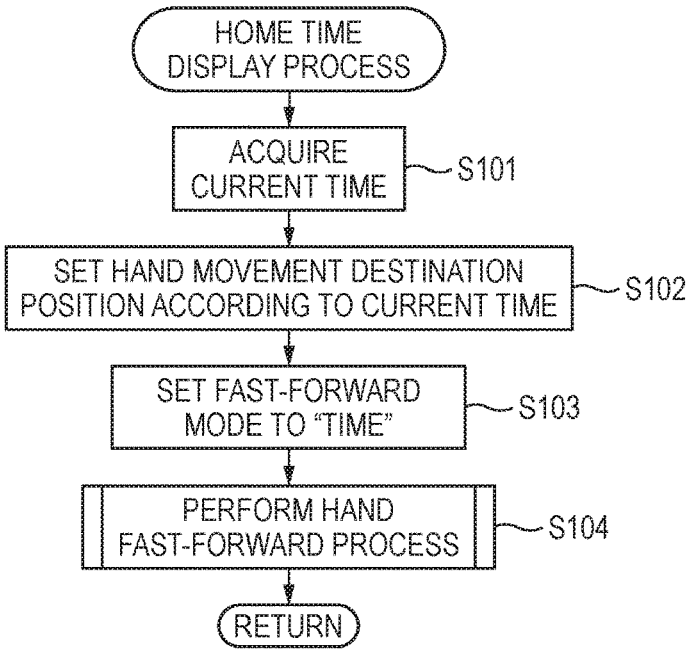
FIG. 4 is a flow chart illustrating the control procedure of a home time display process which is called in the display switching process.

FIG. 4 is a flow chart illustrating the control procedure of the home time display process which is called in the display switching process and is performed by the CPU 41. Also, FIG. 5 is a flow chart illustrating the control procedure of the world timepiece display process which is called in the display switching process and is performed by the CPU 41.

As shown in FIG. 4, if the home time display process is called, in STEP S101, the CPU 41 acquires the current time from the clocking circuit 46, and converts the current time into the local time of the current location (the time of the current location). Subsequently, in STEP S102, the CPU 41 calculates hand movement destination positions according to the time of the current location, and sets the calculated positions. In other words, the movement destination position of the second hand 13 is set to the value in seconds of the current time, and as the movement destination position of the minute hand 12, a value is obtained by adding a digit in tens place in seconds (the quotient obtained by dividing the value in seconds by 10) to six times the value in minutes of the current time. Also, as the movement destination position of the hour hand 11, the sum of thirty times of the remainder after the value in hours of the current time by 12 and the quotient obtained by dividing the value in minutes by 2 is obtained. Subsequently, the CPU 41 sets the fast-forward mode to "TIME" in STEP S103, and calls and performs a hand fast-forward process in STEP S104. After the hand fast-forward process finishes, the CPU 41 finishes the home time display process, and returns to the display switching process.

Figure 5:
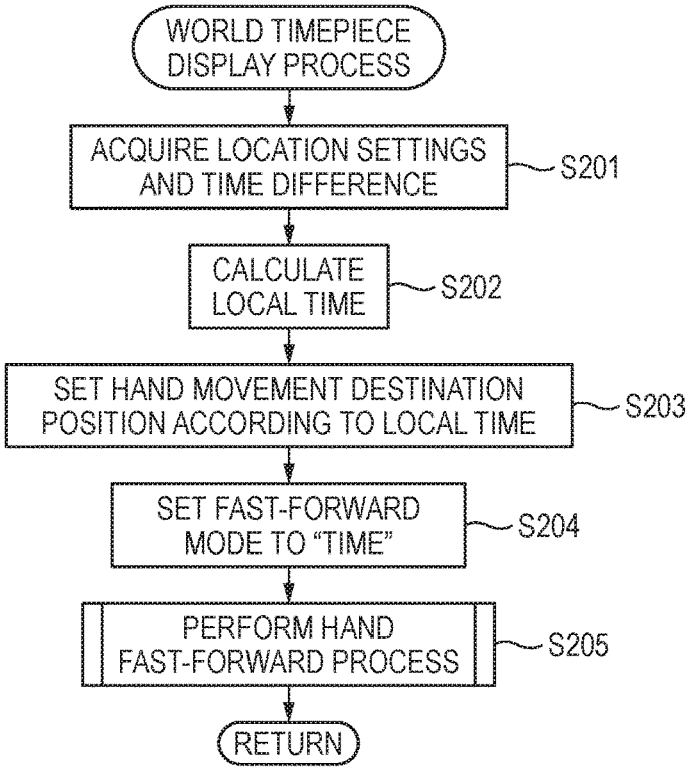
FIG. 5 is a flow chart illustrating the control procedure of a world timepiece display process which is called in the display switching process.

Also, as shown in FIG. 5, if the world timepiece display process is called, in STEP S201, the CPU 41 acquires the local time setting related to the world timepiece function from the RAM 43. Subsequently, in STEP S202, the CPU 41 calculates the local time at a selected location based on the current time acquired from the clocking circuit 46, and time difference information included in the local time setting. Then, in STEP S203, the CPU 41 computes and sets hand movement destination positions according to the local time. Subsequently, the CPU 41 sets the fast-forward mode to "TIME" in STEP S204, the calls and performs the hand fast-forward process in STEP S205. After the hand fast-forward process finishes, the CPU 41 finishes the world timepiece display process, and returns to the display switching process.

Figure 6:
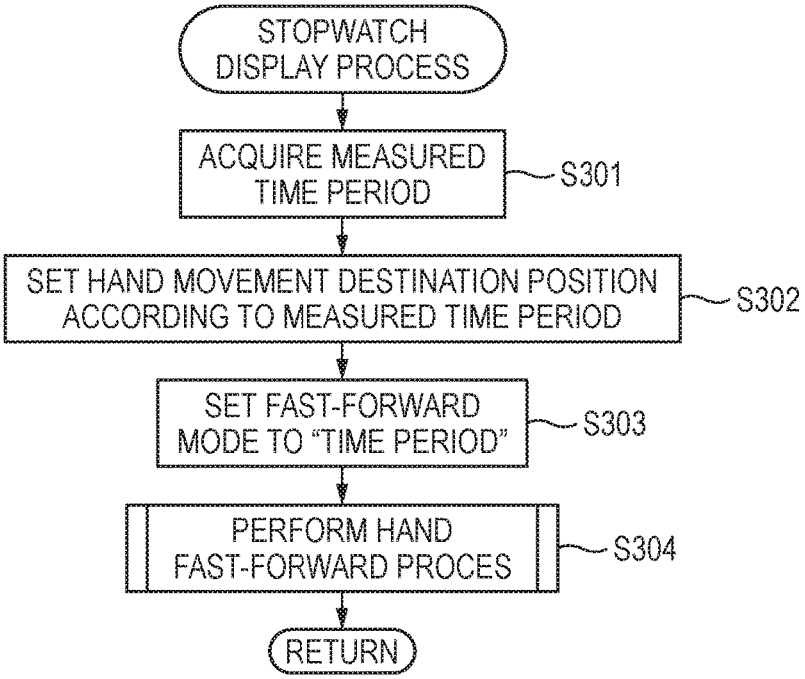
FIG. 6 is a flow chart illustrating the control procedure of a stopwatch display process which is called in the display switching process.

FIG. 6 is a flow chart illustrating the control procedure of the stopwatch display process which is called in the display switching process and is performed by the CPU 41. Also, FIG. 7 is a flow chart illustrating the control procedure of the timer display process which is called in the display switching process and is performed by the CPU 41.

As shown in FIG. 6, if the stopwatch display process is called, in STEP S301, the CPU 41 reads out and acquires a count time period from the RAM 43 when counting is performed by the stopwatch function (regardless of whether counting is being performed or not). Subsequently, in STEP S302, the CPU 41 sets hand movement destination positions according to the count time period. Then, the CPU 41 sets the fast-forward mode to "TIME PERIOD" in STEP S303, and calls and performs the hand fast-forward process in STEP S304. After the hand fast-forward process finishes, the CPU 41 finishes the stopwatch display process, and returns to the display switching process.

Figure 7:
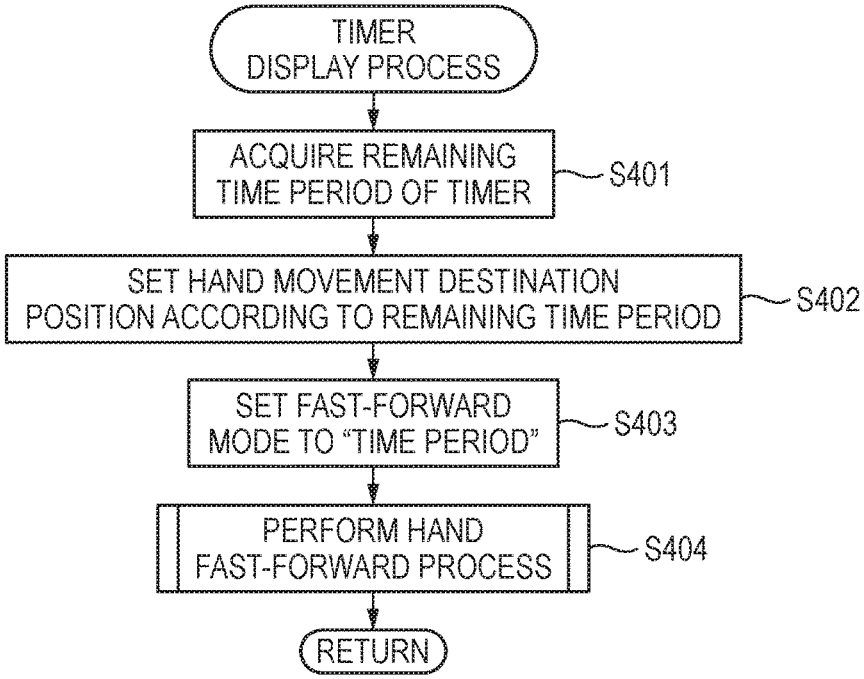
FIG. 7 is a flow chart illustrating the control procedure of a tinier display process which is called in the display switching process.

Also, as shown in FIG. 7, if the timer display process is called, in STEP S401, the CPU 41 reads out and acquires the remaining time period of a timer from the RAM 43 when counting is performed. Subsequently, in STEP S402, the CPU 41 sets hand movement destination positions according to the remaining time period. Then, the CPU 41 sets the fast-forward mode to "TIME PERIOD" in STEP S403, and calls and performs the hand fast-forward process in STEP S404. After the hand fast-forward process finishes, the CPU 41 finishes the timer display process, and returns to the display switching process.

Figure 8:
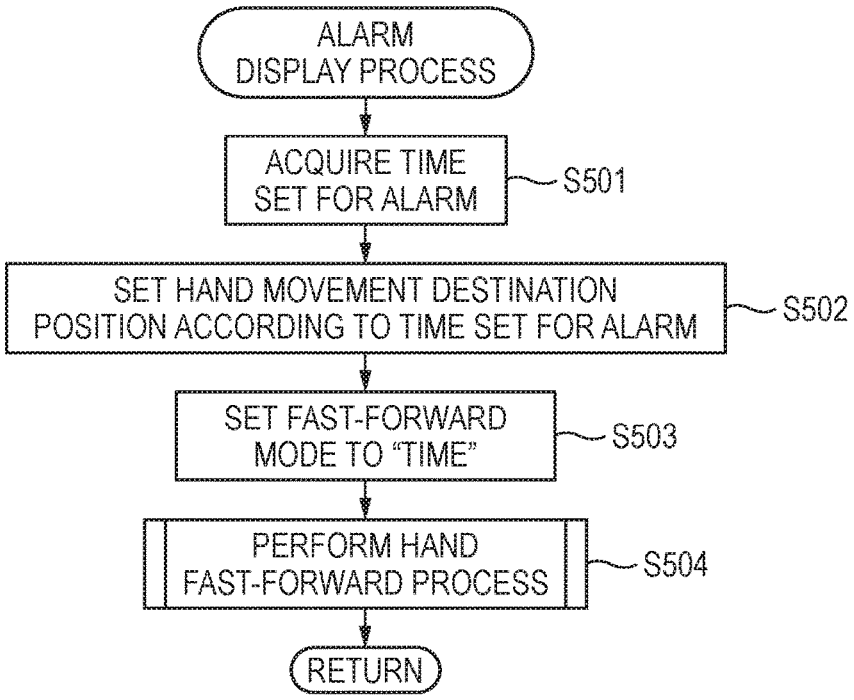
FIG. 8 is a flow chart illustrating the control procedure of an alarm display process which is called in the display switching process.

FIG. 8 is a flow chart illustrating the control procedure of the alarm display process which is called in the display switching process and is performed by the CPU 41.

If the alarm display process is called, in STEP S501, the CPU 41 reads out and acquires an alarm setting time from the RAM 43. Subsequently, in STEP S502, the CPU 41 sets hand movement destination positions according to the alarm setting time. Then, the CPU 41 sets the fast-forward mode to "TIME" in STEP S503, and calls and performs the hand fast-forward process in STEP S504. After the hand fast-forward process finishes, the CPU finishes the alarm display process, and returns to the display switching process.

Figure 9:
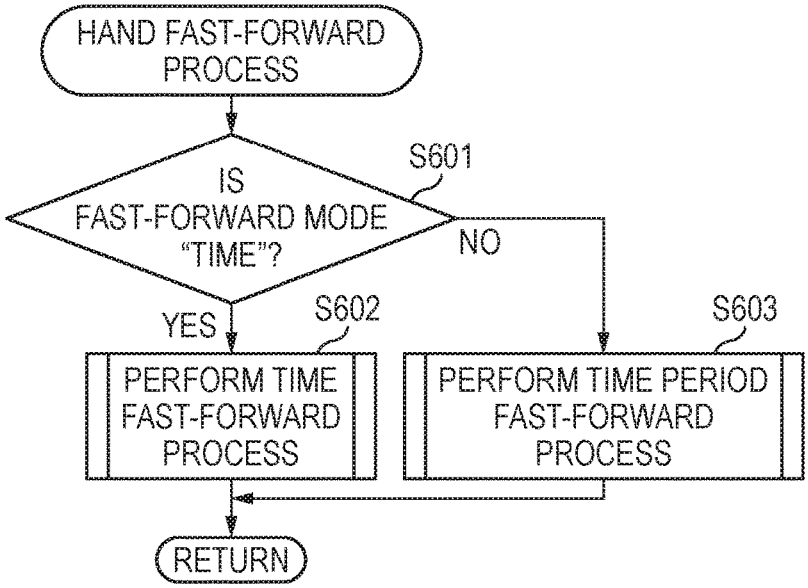
FIG. 9 is a flow chart illustrating the control procedure of a time fast-forward process which is called in a hand fast-forward process.
Figure 10:
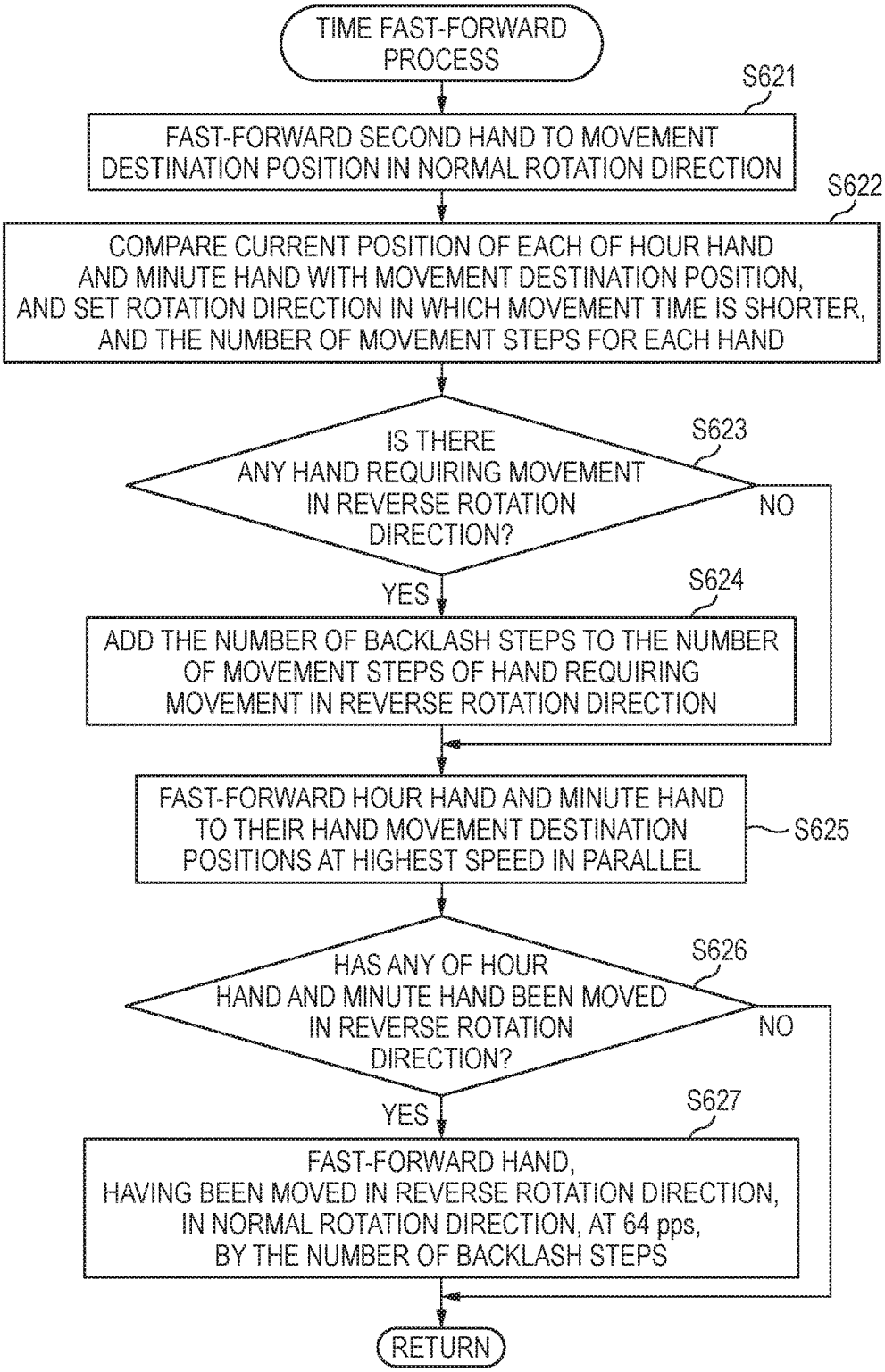
FIG. 10 is a flow chart illustrating the control procedure of a time fast-forward process which is called in a hand fast-forward process in the analog electronic watch of the first embodiment.
Figure 11:
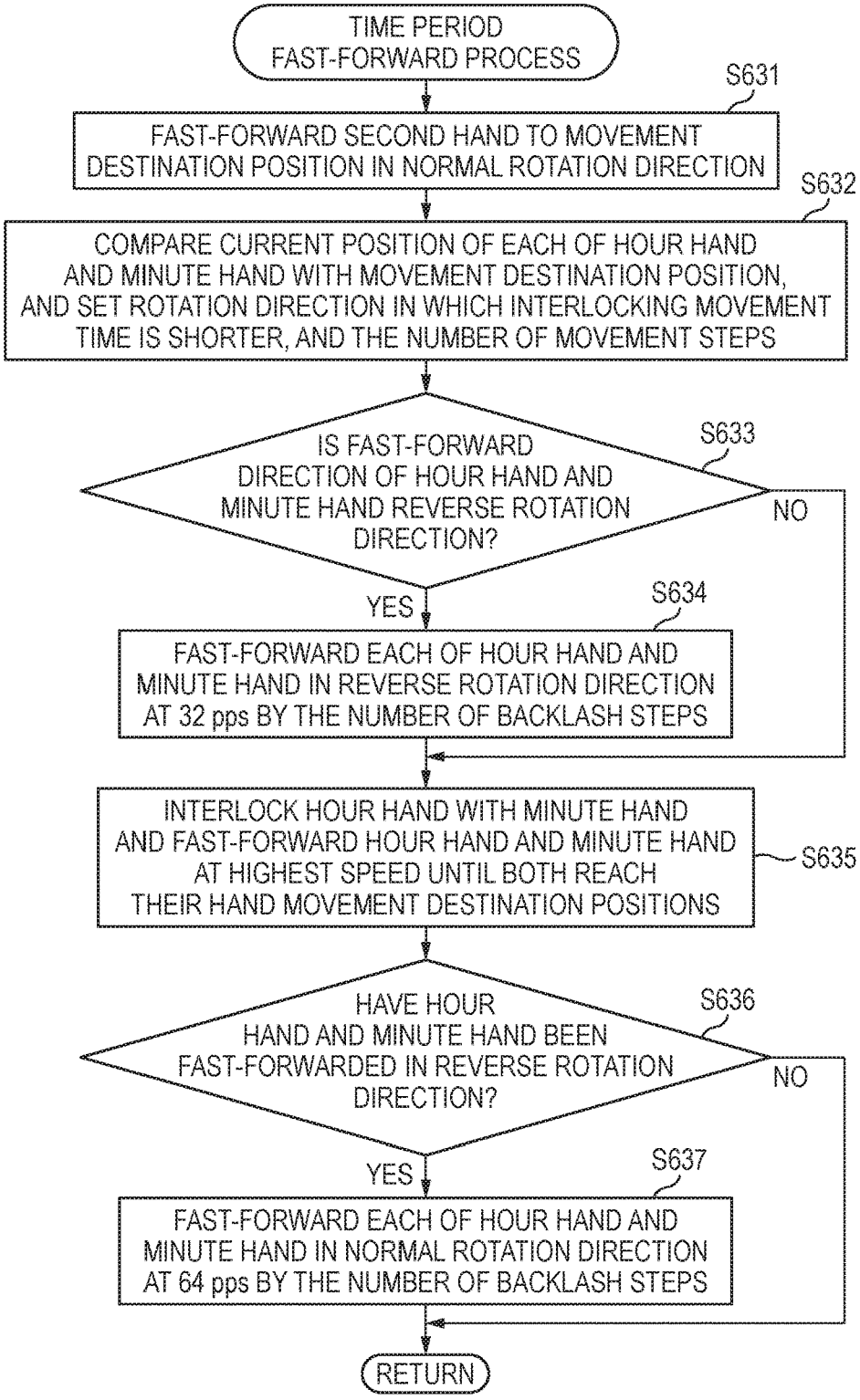
FIG. 11 is a flow chart illustrating the control procedure of a time period fast-forward process which is called in the hand fast-forward process in the analog electronic watch of the first embodiment.

FIG. 9 is a flow chart illustrating the control procedure of the hand fast-forward process which is called in each of the home time display process, the world timepiece display process, the stopwatch display process, the timer display process and the alarm display process and is performed by the CPU 41. Also, FIG. 10 is a flow chart illustrating the control procedure of the time fast-forward process which is called in the hand fast-forward process and is performed by the CPU 41. Also, FIG. 11 is a flow chart illustrating the control procedure of a time period fast-forward process which is called in the hand fast-forward process and is performed by the CPU 41.

As shown in FIG. 9, if the hand fast-forward process is called, in STEP S601, the CPU 41 determines whether the fast-forward mode is "TIME". In a case where it is determined that the fast-forward mode is "TIME", that is, in a case where the type of a display object after switching of display contents attributable to fast-forwarding is related to time ("YES" in STEP S601), in STEP S602, the CPU 41 calls and performs the time fast-forward process. After the time fast-forward process finishes, the CPU finishes the hand fast-forward process and proceeds to a new display switching process. In a case where it is determined that the fast-forward mode is not "TIME", that is, the fast-forward mode is "TIME PERIOD" (a case where the type of a display object after switching of display contents attributable to fast-forwarding is related to a time period) ("NO" in STEP S601), in STEP S603, the CPU 41 calls and performs the time period fast-forward process. After the time period fast-forward process finishes, the CPU finishes the hand fast-forward process and proceeds to a new display switching process.

If the time fast-forward process is called in the process of STEP S602, as shown in FIG. 10, first, in STEP S621, the CPU 41 outputs a control signal to the drive circuit 49, thereby making the drive circuit fast-forward the second hand 13 to the hand movement destination position in the normal rotation direction. The speed of fast-forwarding can be set to 64 pps which is the highest speed.

Subsequently, in STEP S622, the CPU 41 compares the current position and movement destination position of each of the hour hand 11 and the minute hand 12, and selects a direction in which the shortest movement time (the shortest time which is required to move) is shorter, from the normal rotation direction and the reverse rotation direction, and separately sets the selected rotation direction and the number of movement steps for each hand. As described above, in the present embodiment, since fast-forward in the normal rotation direction can be performed at speed which is twice that in the reverse rotation direction, with reference to the current position, in a case where the number of steps to the movement destination position in the normal rotation direction is equal to or less than 240, the normal rotation direction is selected; whereas in a case where the number of steps to the movement destination position in the reverse rotation direction is less than 120, the reverse rotation direction is selected. Subsequently, in STEP S623, the CPU 41 determines whether there is any hand to be moved in the reverse rotation direction. In a case where it is determined that there is a hand to be move in the reverse rotation direction ("YES" in STEP S623), in STEP S624, the CPU 41 reads the number of backlash steps of the corresponding hand to be moved in the reverse rotation direction, out of the ROM 42, and adds the number of backlash steps to the number of movement steps. In other words, in a case of fast-forwarding a hand in the reverse rotation direction, information on the memory represents that the corresponding hand is fast-forwarded to a position further than the first set movement destination position. Subsequently, the process of the CPU 41 proceeds to STEP S625. In a case where it is determined that there is no hand to be moved in the reverse rotation direction ("NO" in STEP S623), the process of the CPU 41 proceeds to STEP S625.

If the CPU proceeds to the process of STEP S625, in STEP S625, the CPU 41 outputs control signals to the drive circuit 49, thereby fast-forwarding the hour hand 11 and the minute hand 12 to their hand movement destination positions, in parallel, and at the highest fast-forward speed which is 64 pps in a case of normal rotation and is 32 pps in a case of reverse rotation. If fast-forwarding finishes, in STEP S626, the CPU 41 determines whether there is any hand having been moved in the reverse rotation direction. In a case where it is determined that there is a hand having been moved in the reverse rotation direction ("YES" in STEP S626), in STEP S627, the CPU fast-forwards the hand having been moved in the reverse rotation direction, in the normal rotation direction by the number of backlash steps, at 64 pps. Then, the CPU 41 finishes the time fast-forward process, and returns to the hand fast-forward process. In a case where it is determined that there is no hand having been moved in the reverse rotation direction ("NO" in STEP S626), the CPU 41 finishes the time fast-forward process, and returns to the hand fast-forward process.

If the time period fast-forward process is called in STEP S603 of the hand fast-forward process, as shown in FIG. 11, first, in STEP S631, the CPU 41 outputs a control signal to the drive circuit 49, thereby making the drive circuit fast-forward the second hand 13 to the hand movement destination position in the normal rotation direction at 64 pps. Subsequently, in STEP S632, the CPU 41 compares the time (interlocking position) corresponding to the current positions of the hour hand and the minute hand, and the time (interlocking position) of their movement destination positions, and selects a rotation direction such that in a case of fast-forwarding time while interlocking the hour hand 11 with the minute hand 12 (fast-forwarding using an interlocking operation), those hands can reach their movement destination positions in a shorter time, and sets the selected rotation direction and the number of movement steps (the number of interlocking operation steps, that is, the number of movement steps of the minute hand 12).

Subsequently, in STEP S633, the CPU 41 determines whether the rotation direction of the hour hand 11 and the minute hand 12 has been set to the reverse rotation direction. In a case where it is determined that the rotation direction has been set to the reverse rotation direction ("YES" in STEP S633), in STEP S634, the CPU 41 reads the number of backlash steps of each of the hour hand 11 and the minute hand 12 out of the ROM 42, and outputs control signals to the drive circuit 49, thereby making the drive circuit fast-forward each of the hour hand 11 and the minute hand 12 in the reverse rotation direction by the number of backlash steps, at 32 pps (during idle rotation, actually, the hour hand 11 and the minute hand 12 do not rotate). Then, the process of the CPU 41 proceeds to STEP S635. Meanwhile, in a case where it is determined that the fast-forward direction has not been set to the reverse rotation direction, that is, the fast-forward destination has been set to the normal rotation direction ("NO" in STEP S633), the process of the CPU 41 proceeds to STEP S635.

If the time fast-forward process proceeds to the process of STEP S635, in STEP S635, the CPU 41 outputs a control signal to the drive circuit 49, thereby making the drive circuit perform fast-forwarding using the interlocking operation by the number of interlocking operation steps having been set, until both of the hour hand 11 and the minute hand 12 reach their hand movement destination positions (interlocking positions of the movement destinations) (that is, until the minute hand 12 makes as many rotations as the number of movement steps of the hour hand 11). If fast-forwarding finishes, in STEP S636, the CPU 41 determines whether the hour hand 11 and the minute hand 12 have been fast-forwarded in the reverse rotation direction. In a case where it is determined that the hands have been fast-forwarded in the reverse rotation direction ("YES" in STEP S636), in STEP S637, the CPU 41 outputs a control signal to the drive circuit 49, thereby making the drive circuit fast-forward each of the hour hand 11 and the minute hand 12 in the normal rotation direction by the number of backlash steps, at 64 pps. In other words, in this case, during idle rotation, actually, the hour hand 11 and the minute hand 12 do not move. Then, the CPU 41 finishes the time period fast-forward process, and returns to the hand fast-forward process. Meanwhile, in a case where it is determined that the hands have not been fast-forwarded in the reverse rotation direction ("NO" in STEP S636), the CPU 41 finishes the time period fast-forward process, and returns to the hand fast-forward process.

As described above, the analog electronic watch 1 of the first embodiment includes the hands 11 to 13 provided so as to be rotatable, and the CPU 41 configured to make a fast-forward operation depending on whether the type of a display object after switching of display contents is "TIME" or "TIME PERIOD" if switching of display contents of the hands 11 to 13 is performed.

Therefore, even in a case where it is difficult to see the small mode hand 15 operating inside the small window 9, since the type of a display object can be determined, it becomes easier to realize a switch display object during switching display contents.

Also, in a fast-forward operation related to switching of display contents, the CPU 41 rotates the hour hand 11 and the minute hand 12 in a rotation direction in which it is possible to move the hour hand 11 and the minute hand 12 to positions corresponding to the display content after switching in the shortest time, in parts unnecessary in terms of expression, the fast-forward time is not prolonged.

Also, the plurality of hands 11 to 13 is provided, and is configured such that the second hand 13 performs display in units of 1 second, and the minute hand 12 performs display in units of 10 seconds, and the hour hand 11 performs display in units of 2 minutes, and in a fast-forward operation related to switching of display contents, the CPU 41 determines whether the type of a display object after switching is "TIME PERIOD" or "TIME". In a case where the type of the display object after switching is "TIME PERIOD", among the plurality of hands 11 to 15, at least the hour hand 11 and the minute hand 12 are fast-forwarded while being interlocked with each other at operation intervals according to the ratio of time units. In a case where the type of the display object after switching is "TIME", the plurality of hands 11 to 15 are independently fast-forwarded to positions corresponding to the display content after switching, respectively.

As described above, since the fast-forward operation is performed along the flow of time display according to elapsed time, the user can more sensorially understand that the display content after switching is the count time period of the stopwatch or the remaining time period of the timer related to "TIME PERIOD".

Also, the analog electronic watch includes the operation unit 47 configured to receive user's operations, and the CPU 41 switches display objects in response to predetermined input operations on the operation unit 47. As described above, in a case where the user switches display objects (functions), it is possible to sensuously show what a switch object is, only by hand display, for the user.

Second Embodiment

Now, an analog electronic watch 1 of a second embodiment will be described.

The components of the analog electronic watch 1 of the second embodiment are identical to the components of the analog electronic watch 1 of the first example, and thus are denoted by the same reference symbols, and will not be described.

Now, a display switching process in the analog electronic watch 1 of the second example will be described.

The display switching process which is performed in the analog electronic watch 1 of the second embodiment is the same as that of the first embodiment, except for the processing content of the time period fast-forward process which is called in the hand fast-forward process, and thus processing contents identical to those of the first embodiment are denoted by the same reference symbols, and will not be described in detail.

Figure 12:
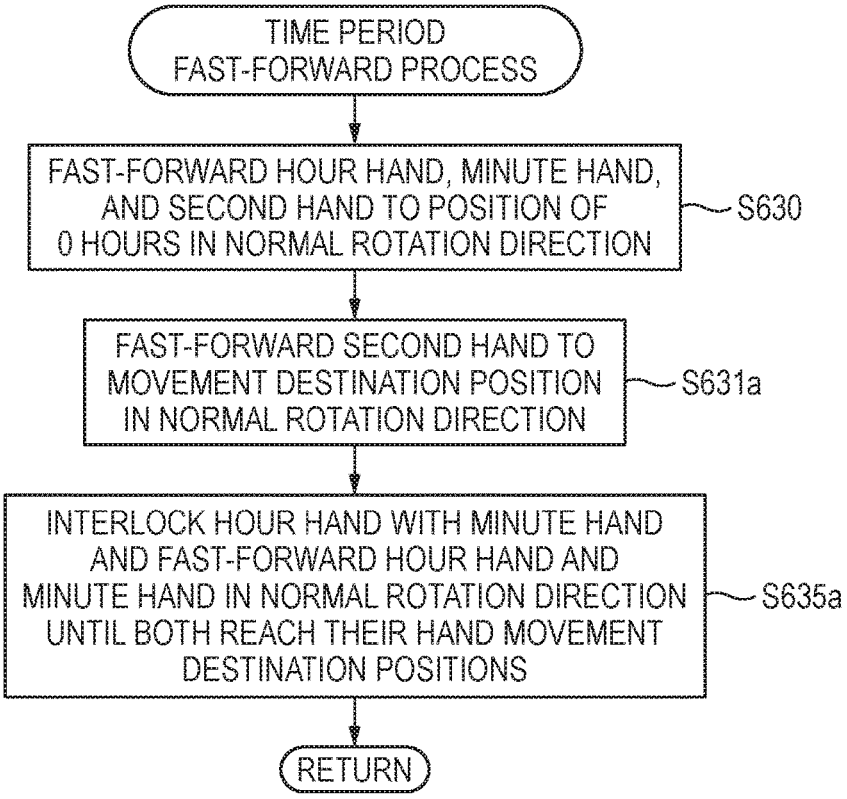
FIG. 12 is a flow chart illustrating the control procedure of a time period fast-forward process which is called in a hand fast-forward process in an analog electronic watch of a second embodiment.

FIG. 12 is a flow chart illustrating the control procedure of the time period fast-forward process which is performed by the CPU 41 and is called in the hand fast-forward process which is performed in the analog electronic watch 1 of the second embodiment.

If the time period fast-forward process is called, in STEP S630, the CPU 41 outputs a control signal to the drive circuit 49, thereby making the drive circuit fast-forward (reset) the hour hand 11, the minute hand 12, and the second hand 13 to the position (a predetermined initial position) at which they exactly indicate 0 o'clock, in the normal rotation direction, at 64 pps, in parallel. Subsequently, in STEP S631*a*, the CPU 41 outputs a control signal to the drive circuit 49, thereby making the drive circuit fast-forward the second hand 13 to its hand movement destination position in the normal rotation direction at 64 pos. Next, in STEP S635*a*, the CPU 41 outputs a control signal to the drive circuit 49, thereby making the drive circuit fast-forward the hour hand 11 and the minute hand 12 by the number of steps corresponding to the value of instructed elapsed time by an interlocking operation, until both of them reach their hand movement destination positions (the interlocking positions of the movement destinations). Then, the CPU 41 finishes the time period fast-forward process, and returns to the hand movement destination position.

As described above, in the analog electronic watch 1 of the second example, in a fast-forward operation related to switching of display contents, only in a case where the type of a display object after switching is "TIME", the CPU 41 fast-forwards, that is, resets the hands 11 to 13 to the predetermined initial position, and then fast-forwards the hands 11 to 13 to positions corresponding to the display content after switching of the display contents.

As described above, since the hands 11 to 13 are first moved such that fast-forwarding related to passage of time is performed from the initial position, it is possible to more clearly show that the switching is switching to time period display, for the user, and differentiate switching to time period display from switching to time display.

Third Embodiment

Now, an analog electronic watch of a third embodiment will be described.

The components of an analog electronic watch 1 of the third embodiment are identical to the components of the analog electronic watch 1 of the first embodiment, and thus are denoted by the same reference symbols and will not be described.

Now, a display switching process of the analog electronic watch 1 of the present embodiment will be described.

The display switching process which is performed in the analog electronic watch 1 of the present embodiment is the same as that of the first embodiment, except in the contents of a time fast-forward process and a time period fast-forward process which are called in a hand fast-forward process, and therefore the contents of processes identical to those of the first embodiment are denoted by the same reference symbols and will not be described.

Figure 13:
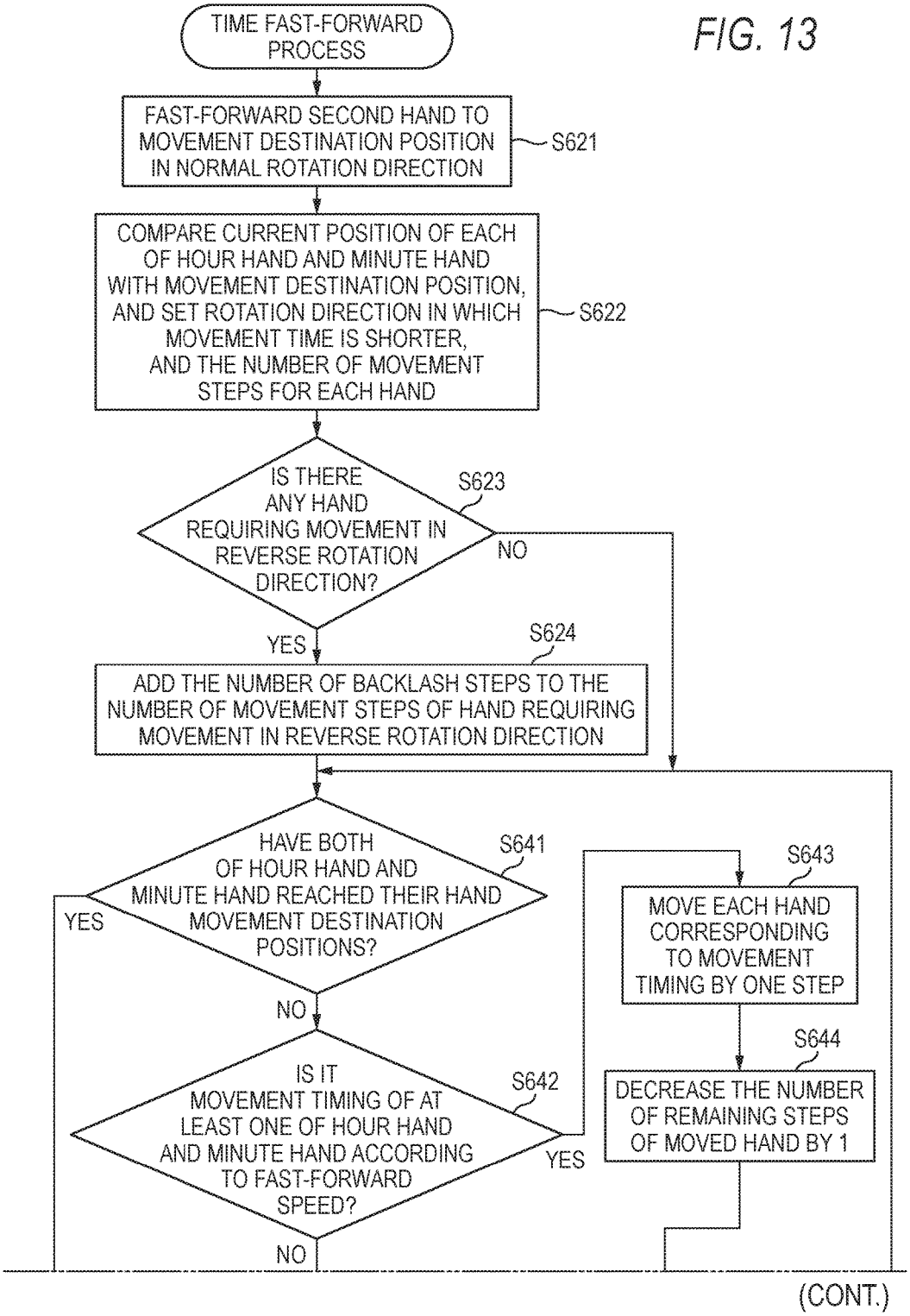
FIG. 13 is a flow chart illustrating the control procedure of a time fast-forward process which is called in a hand fast-forward process in an analog electronic watch of a third embodiment.

FIG. 13 is a flow chart illustrating the control procedure of the time fast-forward process which is called in the hand fast-forward process which is performed in the analog electronic watch of the third embodiment, and is performed by the CPU 41.

This time fast-forward process includes the processes of STEPS S641 to S649, in place of the process of STEP S625 of the time fast-forward process which is called in the analog electronic watch of the first embodiment. The other identical processes will not be described in detail.

If the result of the determining process of STEP S623 is "NO", or the process of STEP S624 finishes, in STEP S641, the CPU 41 determines whether both of the hour hand 11 and the minute hand 12 have reached its hand movement destination position (whether the minute hand 12 has made as many rotations as the number of movement steps of the hour hand 11). In a case where it is determined that at least one of them has not reached ("NO" in STEP S641), in STEP S642, the CPU 41 determines whether it is a movement timing of at least one, based on the fast-forward speeds of the individual hands 11 an 12. In a case where it is determined that it is not a movement timing ("NO" in STEP S642), the time fast-forward process of the CPU 41 returns to STEP S641.

In a case where it is determined that it is a movement timing of at least one hand ("YES" in STEP S642), in STEP S643, the CPU 41 outputs a control signal to the drive circuit 49, thereby moving each hand corresponding to the movement timing, in the set movement direction by one step. Subsequently, in STEP S644, the CPU 41 decrements the number of remaining movement steps of the moved hand by 1. In this case, when the number of steps is set in the process of STEP S622, the number of steps is set as the initial value of the number of remaining movement steps, and in a case where the number of steps is increased in STEP S624, the number of remaining movement steps is also increased.

Subsequently, in STEP S645, the CPU 41 determines whether the number of remaining movement steps of the moved hand is less than 180. In a case where it is determined that the number of remaining movement steps is not less than 180 ("NO" in STEP S645), the CPU 41 sets the fast-forward speed of the corresponding hand to 32 pps in STEP S646, and then returns the time fast-forward process to STEP S641. Meanwhile, in a case where it is determined that the number of remaining movement steps is less than 180 ("YES" in STEP S645), in STEP S647, the CPU 41 determines whether the number of remaining movement steps is less than 45. In a case where it is determined that the number of remaining movement steps is not less than 45 ("NO" in STEP S647), the CPU 41 sets the fast-forward speed of the corresponding hand to 24 pps in STEP S648, and then returns the time fast-forward process to STEP S641. Meanwhile, in a case where it is determined that the number of remaining movement steps is less than 45 ("YES" in STEP S647), the CPU 41 sets the number of remaining movement steps to 16 pps in STEP S649, and then returns the time fast-forward process to STEP S641.

In a case where it is determined in the determining process of STEP S641 that both of the hour hand 11 and the minute hand 12 have reached their hand movement destination positions ("YES" in STEP S641), the time fast-forward process of the CPU 41 proceeds to STEP S626.

In other words, in the time fast-forward process, while a fast-forward operation is being performed, a deceleration operation (a speed change operation) of gradually lengthening the operation intervals between sequent operation timings is performed such that the fast-forward speed decreases (varies) based on the number of remaining movement steps (the remaining movement amount) of the corresponding fast-forward operation. This deceleration operation may not be performed over the entire fast-forward operation, and may be performed after the number of remaining movement steps becomes equal to or less than half of the number of movement steps.

Figure 14:
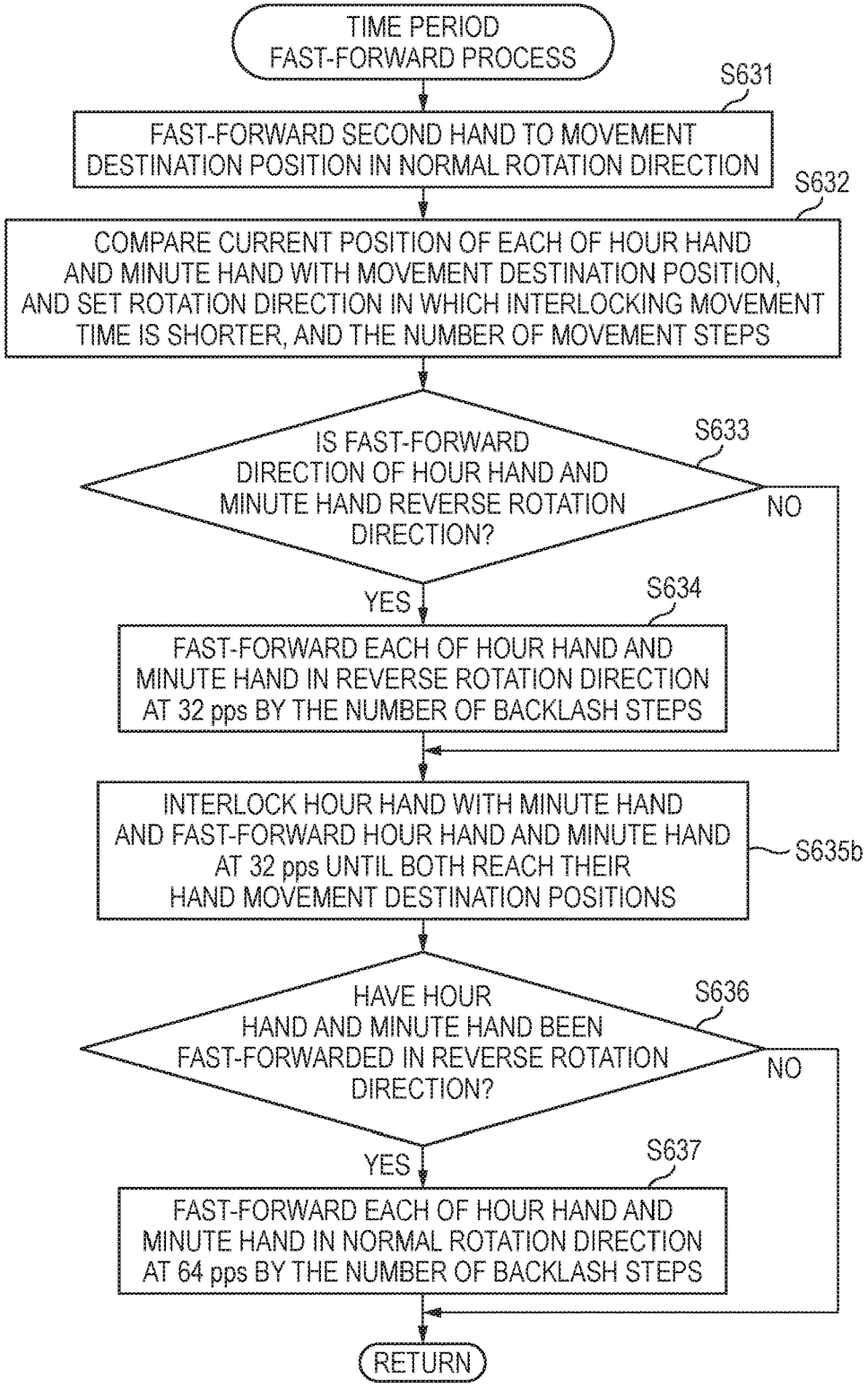
FIG. 14 is a flow chart illustrating the control procedure of a time period fast-forward process which is called in the hand fast-forward process in the analog electronic watch of the third embodiment.

FIG. 14 is a flow chart illustrating the control procedure of the time period fast-forward process which is called in the hand fast-forward process which is performed in the analog electronic watch 1 of the third element, and is performed by the CPU 41.

This time period fast-forward process is the same as the time period fast-forward process which is performed in the analog electronic watch 1 of the first example, except that it include the process of STEP S635*b* in place of the process of STEP S635, and therefore the contents of processes identical to those of the first embodiment are denoted by the same reference symbols, and will not be described.

In this time period fast-forward process, if the result of STEP S633 is "NO", or the process of STEP S634 finishes, the CPU 41 outputs a control signal to the drive circuit 49. As a result, in STEP S635*b*, the hour hand 11 and the minute hand 12 are fast-forwarded by an interlocking operation, until both of the hour hand 11 and the minute hand 12 reach their movement destination positions, that is, the minute hand 12 makes as many rotations as the number of movement steps of the hour hand 11. In other words, the CPU 41 sets the fast-forward speed of fast-forwarding using an interlocking operation to a fixed value, regardless of the direction of fast-forwarding.

As described above, in the analog electronic watch 1 of the third embodiment, in a case where the type of a display object after switching is "TIME", the CPU 41 changes the fast-forward speeds of the hands 12 and 13 during a fast-forward operation related to switching. Therefore, it is possible to clearly differentiate fast-forwarding related to switching from fast-forwarding in a case of passage of time.

Also, in variations in the fast-forward speeds which are controlled by the CPU 41, a speed change operation of changing the fast-forward speeds based on the remaining movement amounts of the hands 11 and 12 in a fast-forward operation related to switching of display contents is included. As described above, since the speeds and the remaining movement amounts are associated with each other, it is possible to achieve the objective of sensuously showing the type of a display object for the user. Further, it is possible to reduce a waste of time and stress of the user in waiting for the hands to move by showing the time required for fast-forwarding to finish.

Also, in a fast-forward operation related to switching of display contents, in a case where the hour hand 11 and the minute hand 12 are fast-forwarded by a time fast-forward process, without an interlocking operation, the CPU 41 changes the fast-forward speeds of the hour hand 11 and the minute hand 12 while fast-forwarding is performed. Meanwhile, in a case where the hour hand 11 and the minute hand 12 are fast-forwarded by an interlocking operation, that is, by a time period fast-forward process, the CPU 41 does not change the fast-forward speeds of the hour hand 11 and the minute hand 12 while fast-forwarding is performed. As a result, according to the concept of performing a fast-forward operation along the flow of time period display according to passage of time related to time fast-forward, the type of time period fast-forward and the type of time fast-forward are differentiated. Therefore, it is possible for the user to more clearly and sensorially realize what type a fast-forward operation is.

Fourth Embodiment

Now, an analog electronic watch of a fourth embodiment will be described.

The components of an analog electronic watch 1 of the fourth embodiment are identical to the components of the analog electronic watch 1 of the first embodiment, and thus are denoted by the same reference symbols and will not be described.

Now, a display switching process of the analog electronic watch 1 of the present embodiment will be described.

The display switching process which is performed in the analog electronic watch 1 of the present embodiment is the same as that of the first embodiment, except that the contents of a time fast-forward process which is called in a hand fast-forward process is different from those which are called in the hand fast-forward processes of the first to third embodiments, and therefore the contents of processes identical to those of the first embodiment are denoted by the same reference symbols and will not be described.

Figure 15:
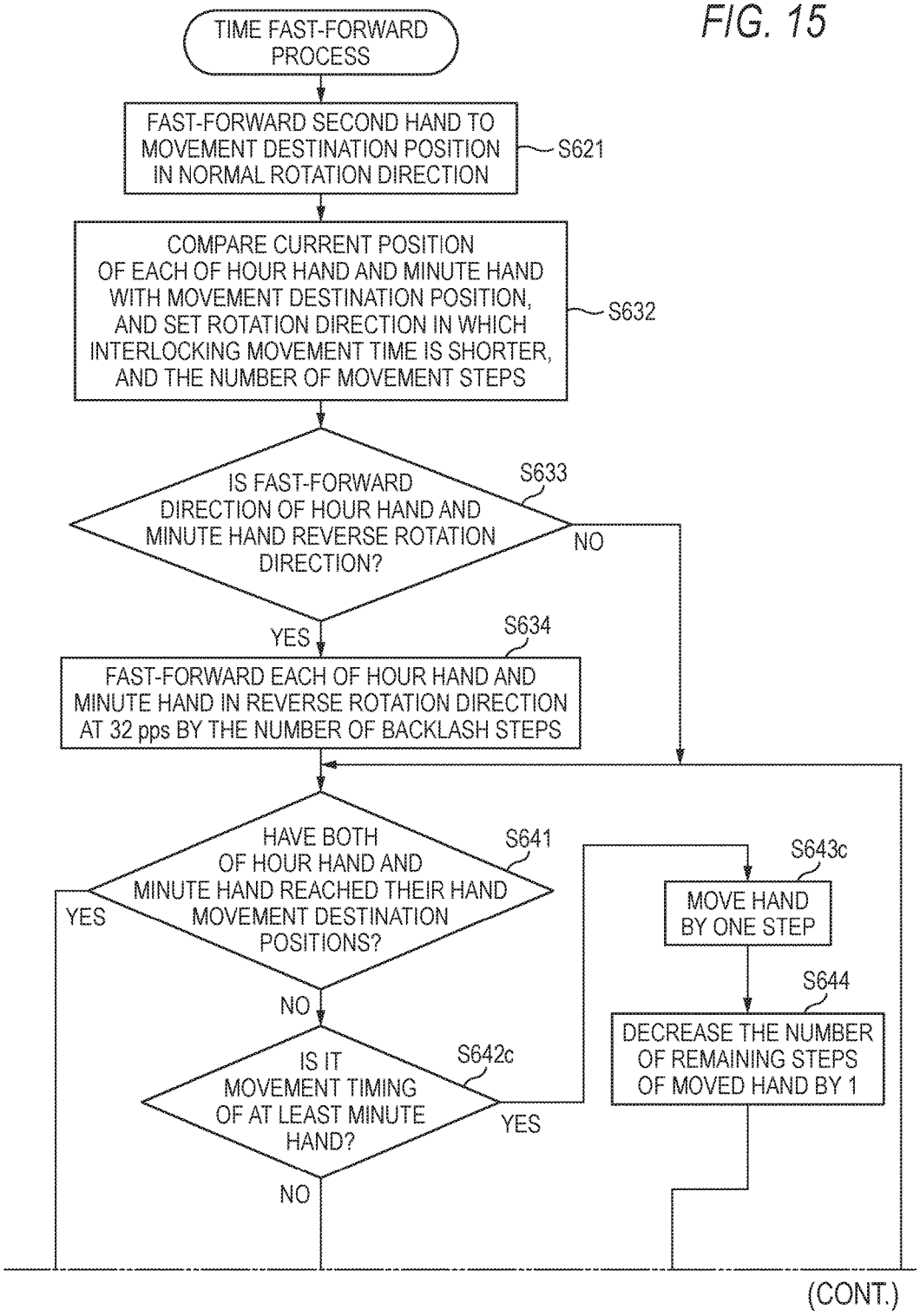
FIG. 15 is a flow chart illustrating the control procedure of a time fast-forward process which is called in a hand fast-forward process in an analog electronic watch of a fourth embodiment.

FIG. 15 is a flow chart illustrating the control procedure of the time fast-forward process which is called in the hand fast-forward process of the fourth embodiment and is performed by the CPU 41.

In this time fast-forward process, the hour hand 11 and the minute hand 12 are fast-forwarded by an interlocking operation. This process includes the processes of STEPS S632 to S637 in place of the processes of STEPS S622 to S627 of the time fast-forward process of the third embodiment, and includes STEPS S642*c* and S643*c* in place of the processes of STEPS S642 and S643, respectively. The other processes are identical to those of the time fast-forward process which is performed in the analog electronic watch 1 of the third embodiment, and the processes of STEPS S632 to S637 are identical to those of the time period fast-forward process which is performed in the analog electronic watch 1 of the third embodiment, and thus a description thereof will not be made.

In a case where it is determined in the process of STEP S641 that at least one of the hour hand and the minute hand has not reached its hand movement destination position, that is, the minute hand 12 has not been moved by the number of set movement steps ("NO" in STEP S641), in STEP S642*c*, the CPU 41 determines whether it is a movement timing of at least the minute hand 12. In a case where it is determined that it is not a movement timing ("NO" in STEP S642*c*), the time fast-forward process of the CPU 41 returns to STEP S641.

In a case where it is determined that it is a movement timing of at least the minute hand 12 ("YES" in STEP S642), the CPU 41 outputs a control signal to the drive circuit 49, thereby moving the minute hand 12 in the set rotation direction by one step. At this time, in a case where it is a timing to move the hour hand 11 by interlocking the hour hand with the minute hand, in STEP S643*c*, the CPU also moves the hour hand 11 in the set rotation direction by one step. Then, the time fast-forward process of the CPU 41 proceeds to STEP S644.

As described above, in the analog electronic watch 1 of the fourth embodiment, in a fast-forward operation, the CPU 41 fast-forwards at least two (the hour hand 11 and the minute hand 12) of the plurality of hands 11 to 13 while interlocking the hands with each other in operation intervals according to the time ratio of their time units. As described above, during time fast-forward or time period fast-forward, a fast-forward operation may be performed according to passage of time. Alternatively, the hour hand 11 and the minute hand 12 may be associated with the operation of a common stepping motor, and a gear train mechanism for rotating the hour hand 11 and the minute hand 12 while interlocking them with each other may be configured. Even in this case, by performing another operation, here, an operation of reducing movement speeds only in a time fast-forward process, similarly, it is possible to sensuously show the type of a display object for the user.

The present invention is not limited to the above described embodiments, and various modifications can be possible.

For example, in the above described embodiments, in a case of performing switching to display related to an elapsed time period, fast-forwarding is performed at fixed speeds by an interlocking operation according to the flow of the time period. However, in a case where it is thought that the case related to passage of time is invariable and is suitable for an interlocking operation, change of time may be performed at fixed speeds by an interlocking operation, whereby change of time may be performed by the individual hands, and the fast-forward speeds may be changed. Also, from them, the user may be able to select any one by an input operation on the operation unit 47.

Also, in the above described embodiments, a case where switching of hours and minutes (the hour hand 11 and the minute hand 12) are different between passage of time and passage of a period has been described. However, with respect to changing of date display or second display, similarly, it is possible to differentiate display switching during passage of time with display switching during passage of a period. In this case, the shapes of hands (including every components configured to rotate to show one information item, such as a rotary disc shape like the date wheel 14) different in fast-forward processes, and the number of such hands can be appropriately changed.

Also, in the above described embodiments, as the order of fast-forwarding, the second hand 13 is first moved, and then the hour hand 11 and the minute hand 12 are moved. However, the order of fast-forwarding may be reversed. The second hand 13 may be fast-forwarded later, and then be moved one second by once second, whereby normal time display and elapsed time count display may be performed.

Also, in some embodiments described above, a rotation direction in which each hand can reach a position corresponding to display content in the shortest time, and in the second embodiment, in the time period fast-forward, each hand is rotated in the normal rotation direction. However, the rotation direction of each hand may be selected in different ways. For example, in a case of fast-forwarding related to the stopwatch function, each hand may be fast-forwarded in the normal rotation direction, and in a case of fast-forwarding related to the timer function, each hand may be rotated in the reverse rotation direction.

Also, in the above described embodiments, switching of display contents attributable to changing of display objects has been described as an example. However, the present invention is not limited thereto. Even in a case of performing switching of display contents with respect to the same display object, that is, in a case where switching of display contents is not switching attributable to passage of time related to execution of a normal function or the like, similarly, it is possible to make perform the fast-forward operation in different ways. For example, in a case of sequentially performing display of the histories of lap times and split times in the stopwatch function, and in a case of sequentially performing display of a plurality of set times in the alarm function, it is possible to apply the present invention to perform fast-forward operations using a time period fast-forward process and a time fast-forward process, respectively.

Also, in the analog electronic watch 1 of the second modification, in a case where a display object after switching is display related to the timer function, during fast-forwarding to initial positions, the hands may be moved to positions according to the initially set count period, and then be fast-forwarded to positions corresponding to the remaining time period of the timer which is counting or is in a stop state, in the reverse rotation direction, without resetting the hands.

Also, in the above described embodiments, the fast-forward speed is decreased according to the number of movement steps. Alternatively, the fast-forward speed may be increased, and after the number of movement steps halves, the fast-forward speed may be decreased.

Also, in each embodiment described above, a case where fast-forwarding based on existence or non-existence of change in fast-forward speed, existence or non-existence of a resetting operation, and an interlocking operation of the minute hand 12 and the hour hand 11, fast-forwarding independent from them, and setting of rotation directions are made different has been described. However, these processing differences can be arbitrarily assembled and set according to the concepts of time period fast-forward and time fast-forward by the subjective view of the user.

Also, here, as an analog electronic watch, the watch including the rotary disc (the date wheel 14) and displaying time and time periods only by the hands 11 to 15. However, any electronic watch having a function of performing display with such hands and performing display using a digital display screen is included in examples of the analog electronic watch.

Also, the analog electronic watch is not limited to the wristwatch, and may be any other watch, such as a portable watch, a table watch, a wall clock, as long as it can perform switching of display contents.

Moreover, the details such as specific components and numerical values shown in the above described embodiments can be appropriately changed without departing from the scope of the present invention.

Although some embodiments of the present invention have been described, the scope of the present invention is not limited to the above described embodiments, and includes the scopes of inventions disclosed in claims and the scopes of their equivalents.

The following is the inventions disclosed in the claims originally attached to this application. The numbering of the claims appended is the same as the numbering of the claims originally attached to this application.

What is claimed is:

1. An analog electronic watch comprising:

a hand that is configured to be rotatable; and a control unit that controls the hand to perform a fast-forward operation during a display switching process that switches a display content to be displayed by the hand, the control unit controlling the hand such that the fast-forward operation differs between (i) a first case in which the display content after the display switching process relates to a current time, and (ii) a second case in which the display content after the display switching process relates to measurement of a time interval, wherein:

in the first case, the control unit changes a fast-forward speed of the hand while the fast-forward operation is being performed, and in the second case, the control unit does not change the fast-forward speed of the hand while the fast-forward operation is being performed.

2. The analog electronic watch according to claim 1, wherein:

the control unit changes the fast-forward speed of the hand based on a remaining movement amount of the hand in the fast-forward operation.

3. The analog electronic watch according to claim 2, wherein:

the control unit selects one of a normal rotation direction and a reverse rotation direction in which to rotate the hand during the fast-forward operation, the one of the normal rotation direction and the reverse rotation direction being a rotation direction by which the hand rotates to a position corresponding to the display content after the display switching process more quickly than the other of the normal rotation direction and the reverse rotation direction.

4. The analog electronic watch according to claim 2, further comprising:

a plurality of hands that are configured to perform display in respective different units of time, and wherein the control unit fast-forwards at least two of the plurality of hands while maintaining a predetermined ratio between the respective units of time in which the at least two hands are configured to perform display.

5. The analog electronic watch according to claim 1, wherein:

in the first case or in the second case, the control unit fast-forwards the hand to an initial position, and fast-forwards the hand from the initial position to a position corresponding to the display content after the display switching process.

6. The analog electronic watch according to claim 5, wherein:

in the second case, the control unit fast-forwards the hand to the initial position, and fast-forwards the hand from the initial position to the position corresponding to the display content after the display switching process.

7. The analog electronic watch according to claim 6, wherein:

the control unit selects one of a normal rotation direction and a reverse rotation direction in which to rotate the hand during the fast-forward operation, the one of the normal rotation direction and the reverse rotation direction being a rotation direction by which the hand rotates to a position corresponding to the display content after the display switching process more quickly than the other of the normal rotation direction and the reverse rotation direction.

8. The analog electronic watch according to claim 5, wherein:

the control unit selects one of a normal rotation direction and a reverse rotation direction in which to rotate the hand during the fast-forward operation, the one of the normal rotation direction and the reverse rotation direction being a rotation direction by which the hand rotates to a position corresponding to the display content after the display switching process more quickly than the other of the normal rotation direction and the reverse rotation direction.

9. The analog electronic watch according to claim 1, wherein:

the control unit selects one of a normal rotation direction and a reverse rotation direction in which to rotate the hand during the fast-forward operation, the one of the normal rotation direction and the reverse rotation direction being a rotation direction by which the hand rotates to a position corresponding to the display content after the display switching process more quickly than the other of the normal rotation direction and the reverse rotation direction.

10. The analog electronic watch according to claim 1, further comprising:

a plurality of hands that are configured to perform display in respective different units of time, and wherein the control unit fast-forwards at least two of the plurality of hands while maintaining a predetermined ratio between the respective units of time in which the at least two hands are configured to perform display.

11. The analog electronic watch according to claim 1, further comprising:

a plurality of hands that are configured to perform display in respective different units of time, wherein in one of the first case and the second case, the control unit fast-forwards at least two of the plurality of hands while maintaining a predetermined ratio between the respective units of time in which the at least two hands are configured to perform display, and in the other of the first case and the second case, the control unit independently fast-forwards the at least two hands to positions corresponding to their respective display contents after the display switching process.

12. The analog electronic watch according to claim 11, wherein:

in the one of the first case and the second case where the control unit independently fast-forwards the at least two hands, the control unit changes the fast-forward speeds of the at least two hands while the fast-forward operation is being performed; and in the other of the first case and the second case where the control unit fast-forwards the at least two hands while maintaining the predetermined ratio between the respective units of time in which the at least two hands are configured to perform display, the control unit does not change the fast-forward speeds of the at least two hands while the fast-forward operation is being performed.

13. The analog electronic watch according to claim 1, further comprising:

an operation receiving unit that is operable a user, wherein the control unit performs the display switching process in response to an operation input to the operation receiving unit.

* * * * *